United States Patent [19]

Miller

[11] Patent Number: 4,964,932

[45] Date of Patent: Oct. 23, 1990

[54] METHOD AND APPARATUS FOR MANUFACTURING DECORATIVE GARLAND

[75] Inventor: Leonard G. D. Miller, Victoria, Australia

[73] Assignee: Xmas-Mil Display Products Pty. Ltd., Victoria, Australia

[21] Appl. No.: 223,044

[22] Filed: Jul. 22, 1988

[30] Foreign Application Priority Data

Jul. 22, 1987 [AU] Australia ..... PI3256

[51] Int. Cl.[5] ..... A47G 33/04

[52] U.S. Cl. ..... 156/174; 428/10; 428/18; 493/958

[58] Field of Search ..... 156/174; 428/10, 18; 493/958

[56] References Cited

U.S. PATENT DOCUMENTS 2,880,540 4/1959 Williams ..... 428/10
3,109,277 11/1963 Raymond et al. ..... 493/958 X
3,215,047 11/1965 Braun ..... 428/10 X
3,459,614 8/1969 Polly ..... 156/174
3,589,970 6/1971 Polly ..... 428/18 X

*Primary Examiner*—David Simmons
*Attorney, Agent, or Firm*—Sughrue, Mion, Zinn, Macpeak & Seas

[57] ABSTRACT

A decorative garland is manufactured by feeding one or more strips of material to an elongated, rotatable mandrel having a longitudinal axis so that each strip of material makes a plurality of passes in the direction of the longitudinal axis as the mandrel is rotated to form a wound bundle having a plurality of layers. A length of tape having adhesive on both sides is secured lengthwise of the mandrel to the material wound onto the mandrel after each pass. At least one more pass is made so that the material is fixed to both sides of the tape. The wound bundle is then cut from the mandrel along a line in the direction of the longitudinal axis opposite the tape connection so that the wound bundle can be removed from the mandrel with every piece of material being disposed in direct adhesive contact with one of the lengths of adhesive tape so that the assembly will be completely held together during handling prior to a twisting step.

9 Claims, 5 Drawing Sheets

METHOD AND APPARATUS FOR MANUFACTURING DECORATIVE GARLAND

Figure 1:
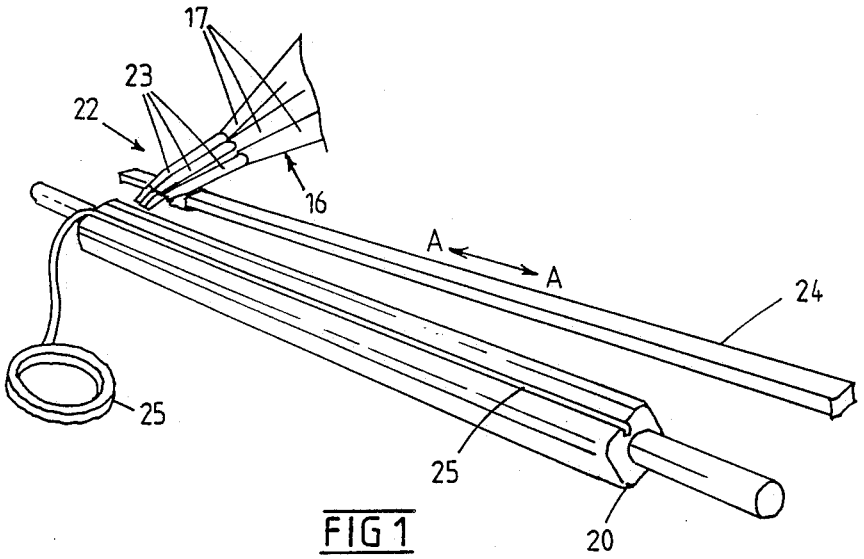

This invention relates to an improved method and apparatus for manufacturing decorative garland.

By the term "decorative garland" is meant decorative material which is wound or otherwise located about a central core the decorative material comprising a plurality of strips which are arranged to extend laterally from the central core. The garland may be in the form of elongated strings of material or alternatively comprise ball-like members which can also be strung together. The garland so formed can be used in the production of a variety of decorative articles taking many different shapes.

U.S. Pat. No. 3,109,277 to Raymond discloses a method and apparatus for manufacturing garland. The apparatus includes a spinning unit in which material is wound onto a mandrel. The wound material is cut from the mandrel and falls into a trough which during the cutting operation is disposed immediately below the mandrel. A pair of wires are arranged one above and one below the material and a twisting unit is provided to twist the wires together so as to form the cut strands into a unit.

The apparatus described in the aforementioned specification is particularly complicated and this appears to be as a result of the difficulties in handling the material after it is cut from the mandrel. The specification recognizes the difficulties in handling bulk quantities of finely divided fibrous material and to overcome this problem has devised a work holding unit and twisting unit which is not only complicated but would be expensive to install and maintain.

Furthermore, with the product of the Raymond specification it would not be possible to transport it in a partially completed state. It will be appreciated that in the completed form garland is a bulky item and prone to damage.

U.S. Pat. No. 3,215,047 to Braun discloses a method of manufacturing branch material for artificial trees in which a flexible strip of material is fed between a pair of rollers and simultaneously cut into a series of fingers. The strip is then disposed between two wires which are twisted together to displace the fingers relative to one another. In this system a complicated wire feeding and cutting mechanism is required to form the branches all these steps being effected together.

It is an object of the present invention to provide an improved method of manufacturing garland in which the product in its partially finished form can be readily handled.

It is another object of the present invention to provide an improved garland when manufactured by the method according to the invention.

According to the present invention there is provided a method of manufacturing decorative garland comprising:

a winding step in which one or more strips of material are fed to an elongated rotatable mandrel having a longitudinal axis, the or each strip of material making one or more passes in the direction of the longitudinal axis as the mandrel is rotated so that the or each strip of material is wound onto the mandrel so as to form a wound bundle comprising one or more layers;

a securement step in which before and/or after one of the passes a length of binding material is applied to the wound bundle in the direction of the longitudinal axis;

a cutting step in which the wound bundle is cut from the mandrel by cutting along one edge thereof in the direction of the longitudinal axis so that the wound bundle can be removed from the mandrel and is in the form of an elongated band comprising a plurality of laterally extending strands which extend generally laterally with respect to the longitudinal axis the strands being held together in the band by virtue of the binding material applied during the binding step.

The method may further include a twisting step in which the band is located between two flexible lines which are thereafter twisted together thereby holding captive the strands in the band and causing therein to be distributed about the twisted lines.

Preferably the securement step is made between each pass of the material along the mandrel. In a preferred form the securement step comprises fixing a length of adhesive tape to the material along the length of the mandrel. Preferably the tape has adhesive on both sides.

The flexible lines may be in the form of a pair of wires and the material may be in the form of plastics ribbon.

Further according to the present invention there is provided a garland when made by the method described above.

A preferred embodiment of the invention will hereinafter be described with reference to the accompanying drawings in which:

FIGS. 1 to 8 are schematic views of the various steps in the method of manufacturing a garland according to the invention.

Figure 8:
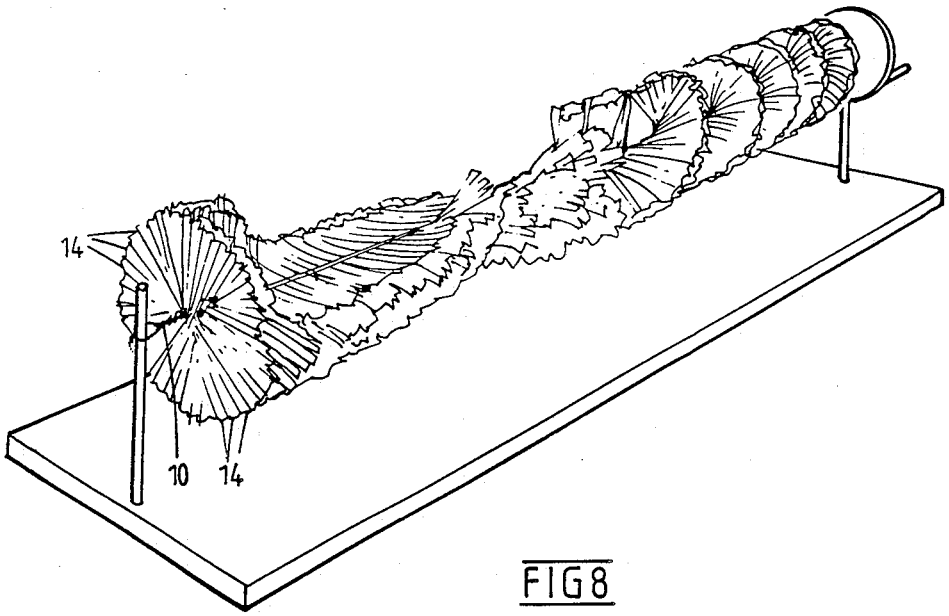

The garland which can be produced by the present invention is best seen in FIG. 8. In FIG. 8 the garland has not been finished however it will be seen from the left hand end that it comprises an elongated element having a central core 10 comprising two twisted wires 11 and 12 and a plurality of strips 14 of decorative material which extend laterally or generally radially from the core. Although the decorative strips can be of any suitable material it is preferable they are formed from plastics ribbon.

In the formation of the product, decorative material 16 in the form of a plurality of strips and ribbons 17 are fed onto a rotatable mandrel 20 via a feed device 22 which is mounted on a carriage 24. The feed device 22 is arranged so that it can move along the carriage 24 generally parallel to the mandrel 20 so as to be capable of making a number of passes back and forth in the direction of arrow A—A. As shown the feed device 22 comprises a plurality of tubes 23 which feed four ribbons of material to the mandrel 20. The material fed to the mandrel can be taken from suitable carriers such as rolls or the like.

Prior to feeding the material to the mandrel 20 a strip of adhesive tape 25 is secured along the length of the mandrel. The tape 25 has an adhesive surface facing outwardly which contacts the material 23 as it is fed onto the mandrel. The purpose of the tape will become readily apparent hereinafter.

Figure 2:
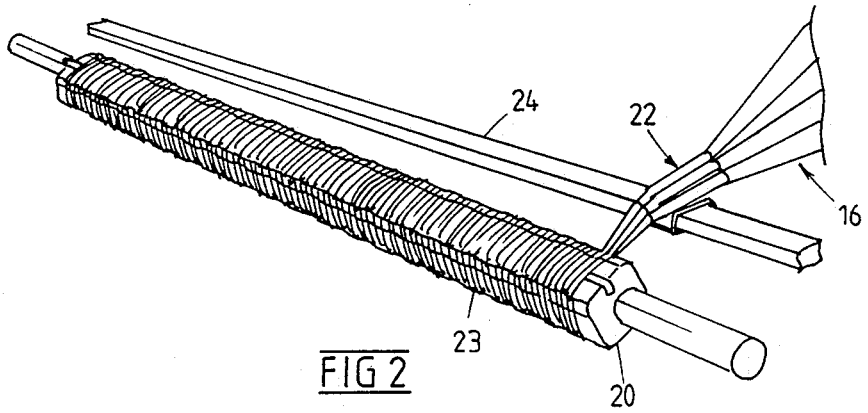
Figure 3:
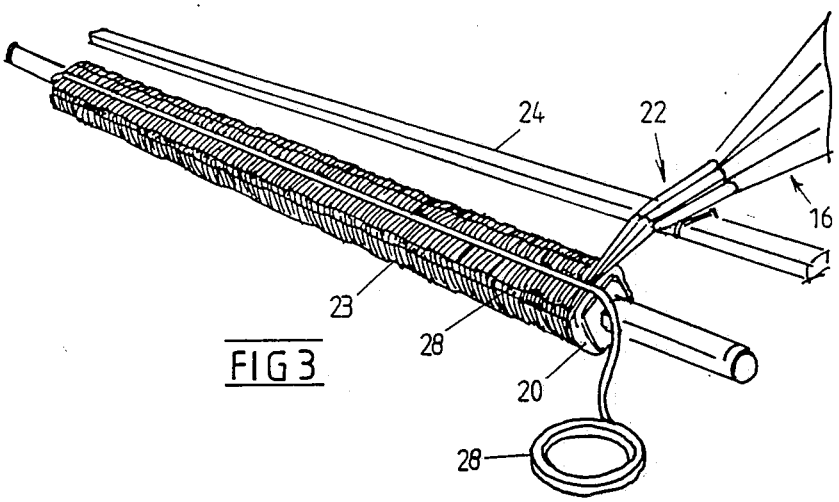
Figure 4:
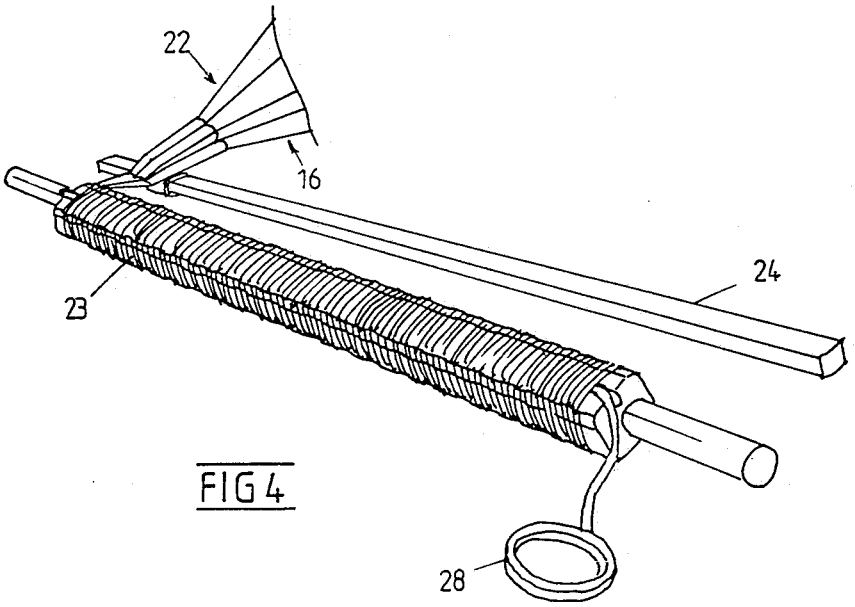

During the first step of the method, the feed device 22 moves along parallel to the mandrel so as to deposit a layer of material thereon (FIGS. 1 & 2). After this is completed a strip of double sided adhesive tape 28 is applied along one side of the material on the mandrel and a further pass is made winding an additional layer of material onto the mandrel. Once this is completed a further strip of tape is applied to the upper surface of the layer and this process is effected for as many layers as required.

Figure 5:
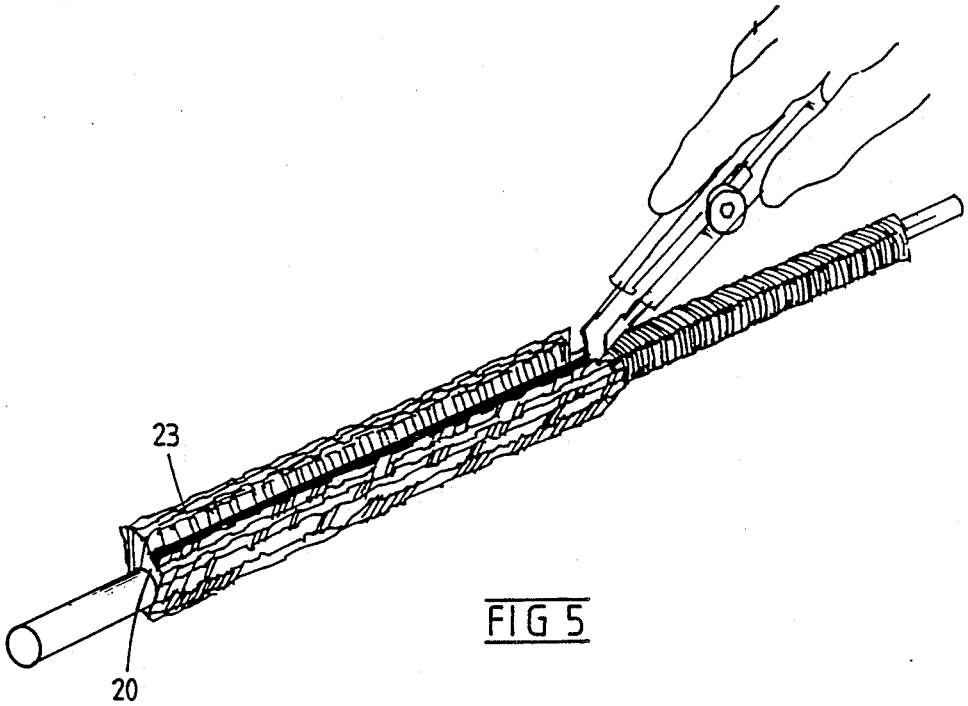
Figure 6:
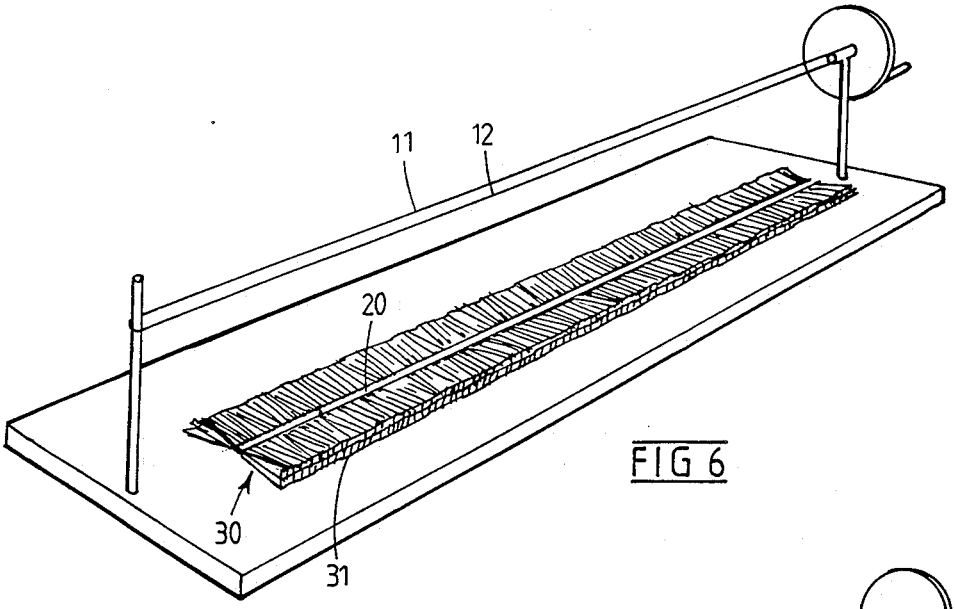
Figure 7:
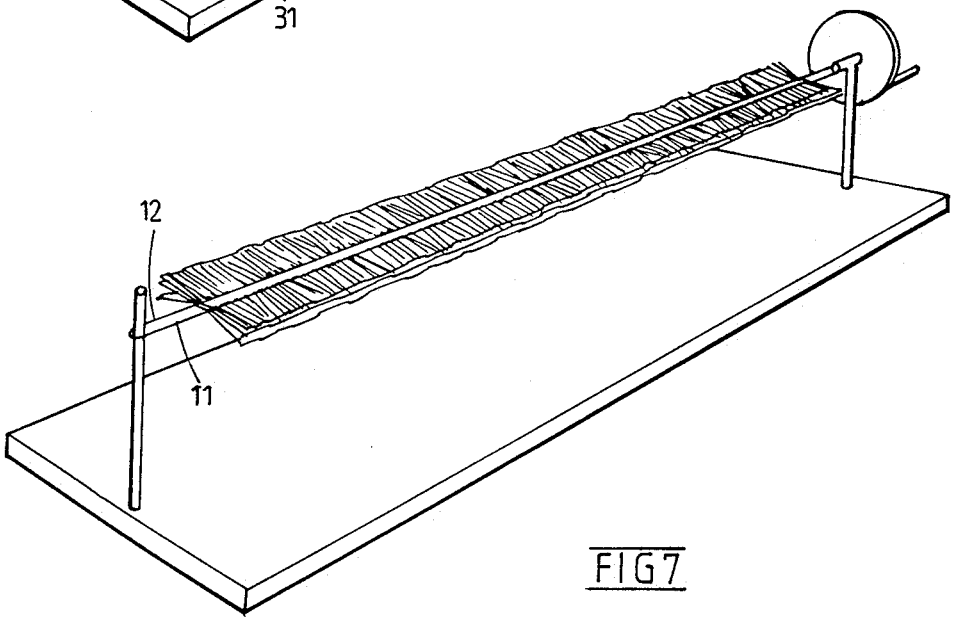

When the above process is completed the material is removed from the mandrel by cutting along one edge (FIG. 5). The removed material forms a band or strip 30 in which a plurality of pieces 31 extend laterally from a central longitudinal axis is temporarily held together by means of the strips of adhesive tape. The provision of the temporary holding tapes ensure that the band 30 can be handled and moved without falling apart.

The band 30 is located between parallel wires 11 and 12 and thereafter the wires are twisted together. The twisting of the wires provides a positive securement for the pieces 31 as well as distributing them generally radially about the central core.

The present invention provides a method of manufacture giving many advantages over prior art technique. For example, whilst the invention as described has been in relation to the manufacture of lengths of garland, the method allows by the use of various shaped mandrels and spinning machines to produce large and small wreaths, cone Christmas trees, signs and figurines depicting various characters, designs of shields, pole or stand units for street and store decorations, top airy tress, king size supporter leis, ball garland, tapered garlands, all these various articles being suitable for commercial use and being of relatively large size.

Furthermore, many mixes of colours and materials may be used in a single garland if desired. Materials which may be used are polyesters, PVC, polythene, cellophane, polypropaline, tissue paper and various synthetic fabrics.

A further most important advantage of the present invention is that the garland can be readily handled in a semi-finished state. This is to say after it has been cut from the mandrel the partially finished garland is in the form of an elongated band secured together by the adhesive tape 25. As such, this band of material can be packed in cartons for storage and/or transport to other locations where upon the final twisting step can be performed.

I claim:

1. A method of manufacturing decorative garland including:

a winding step in which one or more strips of material are fed to an elongated rotatable mandrel having a longitudinal axis, the or each strip of material making one or more passes in the direction of the longitudinal axis as the mandrel is rotated so that the or each strip of material is wound onto the mandrel so as to form a wound bundle comprising one or more layers;

a securement step which includes securing a length of tape having adhesive on both sides lengthwise of the mandrel to the material wound onto the mandrel after each pass and making at least one more pass so that the material is fixed to both sides of the tape;

a cutting step in which the wound bundle is cut from the mandrel by cutting along one edge thereof in the direction of the longitudinal axis so that the wound bundle can be removed from the mandrel and is in the form of an elongated band comprising a plurality of laterally extending strands which extend generally laterally with respect to the longitudinal axis, the strands being held together in the band by virtue of the tape applied during the binding step.

2. A method according to claim 1 further including a twisting step in which the band is located between two flexible lines which are thereafter twisted together thereby holding captive the strands in the band and causing therein to be distributed about the twisted lines.

3. A method according to claim 2 wherein said flexible lines comprise a pair of wires.

4. A method according to claim 3 wherein the said material comprises plastic ribbon.

5. A method according to claim 1, wherein said securement step further includes initially applying an initial length of tape having adhesive on one side to the mandrel prior to making a pass of material along the mandrel with said adhesive side facing away from said mandrel.

6. A method according to claim 5, wherein said securement step further includes applying a length of adhesive tape to the material after the final pass, the tape having adhesive on one side with the adhesive being in contact with the material.

7. A decorative garland when made by the method of claim 1.

8. A method of manufacturing decorative garland including:

a winding step in which one or more strips of material are fed to an elongated rotatable mandrel having a longitudinal axis, the or each strip of material making one or more passes in the direction of the longitudinal axis as the mandrel is rotated so that the or each strip of material is wound onto the mandrel so as to form a wound bundle comprising one or more layers;

a securement step in which before the first of said passes a length of adhesive tape is secured to the mandrel in the longitudinal direction the adhesive tape having an adhesive side facing away from the mandrel and between each of said passes a length of adhesive tape with adhesive material on both sides is applied to the material wound onto the mandrel in the longitudinal direction and after the final pass a length of adhesive tape is applied to the outer layer of material in the longitudinal direction, each said length being applied at one side of the mandrel;

a cutting step in which the wound bundle is cut from the mandrel by cutting along another side of the mandrel in the direction of the longitudinal axis so that the wound bundle can be removed from the mandrel and is in the form of elongated band comprising a plurality of laterally extending strands which extend generally laterally with respect to the longitudinal axis the strands the strands being held together in the band by virtue of the binding material applied during the securement step; and a twisting step in which the band is located between two flexible lines which are thereafter twisted together thereby holding captive the strands in the band and causing the strands to be distributed about the twisted lines.

9. A decorative garland when made by the method of claim 8.

* * * * *